US008701898B2

(12) United States Patent
Chai

(10) Patent No.: US 8,701,898 B2
(45) Date of Patent: Apr. 22, 2014

(54) ADJUSTABLE SHELF ASSEMBLY AND APPLIANCES INCORPORATING THE ADJUSTABLE SHELF ASSEMBLY

(75) Inventor: Biao Chai, Dunedin (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 217 days.

(21) Appl. No.: 13/129,941

(22) PCT Filed: Nov. 24, 2009

(86) PCT No.: PCT/NZ2009/000256

§ 371 (c)(1),
(2), (4) Date: Jun. 3, 2011

(87) PCT Pub. No.: WO2010/062195

PCT Pub. Date: Jun. 3, 2010

(65) Prior Publication Data

US 2011/0247990 A1 Oct. 13, 2011

Related U.S. Application Data

(60) Provisional application No. 61/118,569, filed on Nov. 28, 2008.

(51) Int. Cl.

| | |
|---|---|
| ***A47G 19/08*** | (2006.01) |
| *A47F 5/08* | (2006.01) |
| *A47G 29/02* | (2006.01) |
| *A47B 77/08* | (2006.01) |
| *B65D 6/08* | (2006.01) |

(52) U.S. Cl.
USPC ..... 211/41.6; 211/41.8; 211/150; 248/240; 312/228.1; 220/488

(58) Field of Classification Search
USPC ..... 211/41.1–41.9, 150, 144, 186, 187, 211/153; 312/351, 311, 228.1; 108/134, 108/135; 220/486–491; 134/134, 135; 248/125.1, 238, 235, 240, 240.4
See application file for complete search history.

(56) References Cited

U.S. PATENT DOCUMENTS 388,981 A * 9/1888 Barbe ..... 297/423.26
920,343 A * 5/1909 Kelly ..... 108/94

(Continued)

FOREIGN PATENT DOCUMENTS

EP 0937436 8/1999
EP 1275336 1/2003

(Continued)

OTHER PUBLICATIONS

International Search Report for PCT/NZ2009/000256 completed Jan. 14, 2010 (4 pages).

(Continued)

*Primary Examiner* — Joshua J Michener
*Assistant Examiner* — Devin Barnett
(74) *Attorney, Agent, or Firm* — Clark Hill PLC

(57) ABSTRACT

An adjustable shelf assembly for a dishwasher system is used to hold cups, bowls, spoons and other crockery items that are placed within the dishwasher. The vertical position of the shelf assembly within the dishwasher tub is adjusted by an adjustment mechanism comprising a carrier and a gripping projection. The gripping projection can move between a gripping position and sliding position. The carrier slides up and down a vertical bar. The adjustable shelf is capable of moving between a stowed position and a deployed position. In the deployed position the shelf can support crockery items. The shelf can be moved and held at any position between the deployed and stowed positions. The shelf assembly includes a cam mechanism that allows the shelf to move between a deployed position and a stowed position. The shelf is partially curved in the stowed position and flexes to become straight in the deployed position.

6 Claims, 13 Drawing Sheets

(56) References Cited

U.S. PATENT DOCUMENTS

| | | | | |
|---|---|---|---|---|
| 1,302,542 | A * | 5/1919 | Hardman | 108/134 |
| 1,667,657 | A * | 4/1928 | Dobert | 211/99 |
| 1,890,448 | A * | 12/1932 | Berg | 108/62 |
| 2,035,074 | A * | 3/1936 | Kauffman | 292/58 |
| 2,037,309 | A * | 4/1936 | Brown | 292/57 |
| 2,469,966 | A * | 5/1949 | Idle | 211/85.31 |
| 2,494,798 | A * | 1/1950 | Dobkin | 108/134 |
| 2,498,428 | A * | 2/1950 | Kruse | 108/135 |
| 2,646,809 | A * | 7/1953 | Van Hise | 134/182 |
| 2,885,087 | A * | 5/1959 | Bliss | 211/41.4 |
| 2,928,551 | A * | 3/1960 | Abrams et al. | 211/59.4 |
| 2,932,544 | A * | 4/1960 | Lambert | 297/163 |
| 3,050,355 | A * | 8/1962 | Hess et al. | 108/9 |
| 3,244,146 | A * | 4/1966 | Kurtz et al. | 119/481 |
| 3,364,885 | A * | 1/1968 | Brothers | 108/134 |
| 3,934,728 | A * | 1/1976 | Guth | 211/41.9 |
| 4,159,122 | A * | 6/1979 | Stevens | 280/166 |
| 4,830,200 | A * | 5/1989 | Zambano et al. | 211/133.5 |
| 5,205,419 | A * | 4/1993 | Purtilo | 211/41.8 |
| 5,249,590 | A * | 10/1993 | Jacobus et al. | 134/135 |
| 5,287,984 | A * | 2/1994 | Michael | 220/812 |
| 5,344,029 | A * | 9/1994 | Oghia et al. | 211/41.8 |
| 5,497,890 | A * | 3/1996 | Clark | 211/41.8 |
| 6,487,979 | B2 * | 12/2002 | Ash et al. | 108/44 |
| 6,546,942 | B2 * | 4/2003 | Smith et al. | 134/201 |
| 7,032,604 | B2 * | 4/2006 | Welch | 134/135 |
| 7,080,417 | B2 * | 7/2006 | Jiang | 4/578.1 |
| 7,137,397 | B2 * | 11/2006 | Rosenbauer et al. | 134/56 D |
| 7,665,475 | B2 * | 2/2010 | Hedstrom et al. | 134/134 |
| 7,739,964 | B2 * | 6/2010 | Hatton | 108/47 |
| 7,757,615 | B2 * | 7/2010 | McDonald et al. | 108/108 |
| 7,766,175 | B2 * | 8/2010 | Jadhav et al. | 211/41.9 |
| 8,042,559 | B2 * | 10/2011 | Choi et al. | 134/137 |
| 8,079,553 | B1 * | 12/2011 | Martin | 248/145 |
| 8,087,519 | B2 * | 1/2012 | Bramley et al. | 211/41.3 |
| 8,479,664 | B2 * | 7/2013 | Nelson | 108/42 |
| 8,522,998 | B2 * | 9/2013 | Crookshanks et al. | 220/488 |
| 8,567,882 | B1 * | 10/2013 | Garnett | 312/228.1 |
| 2002/0073899 | A1 * | 6/2002 | Chen | 108/44 |
| 2002/0163285 | A1 * | 11/2002 | Vanlandingham | 312/311 |
| 2002/0185166 | A1 * | 12/2002 | Rosenbauer et al. | 134/200 |
| 2003/0188672 | A1 * | 10/2003 | Parent et al. | 108/134 |
| 2005/0268945 | A1 * | 12/2005 | Hedstrom et al. | 134/25.2 |
| 2006/0021641 | A1 * | 2/2006 | Groll et al. | 134/135 |
| 2006/0113260 | A1 * | 6/2006 | Purushothaman et al. | 211/41.8 |
| 2007/0039904 | A1 * | 2/2007 | Purushothaman | 211/41.8 |
| 2007/0039905 | A1 * | 2/2007 | Purushothaman | 211/41.8 |
| 2007/0131696 | A1 * | 6/2007 | Schessl et al. | 220/489 |
| 2007/0199584 | A1 * | 8/2007 | Koch et al. | 134/135 |
| 2008/0135505 | A1 * | 6/2008 | Frankel et al. | 211/41.4 |
| 2008/0272126 | A1 * | 11/2008 | Crookshanks et al. | 220/486 |
| 2009/0038657 | A1 * | 2/2009 | Kang | 134/137 |
| 2009/0120883 | A1 * | 5/2009 | Jadhav et al. | 211/41.9 |
| 2009/0165771 | A1 * | 7/2009 | Selk | 126/25 R |
| 2011/0133614 | A1 * | 6/2011 | Bastuji | 312/228.1 |
| 2011/0233158 | A1 * | 9/2011 | Haider | 211/41.8 |
| 2011/0253650 | A1 * | 10/2011 | Renz et al. | 211/41.9 |
| 2012/0031861 | A1 * | 2/2012 | Haltmayer et al. | 211/41.9 |
| 2012/0055891 | A1 * | 3/2012 | Clores | 211/41.8 |
| 2012/0062085 | A1 * | 3/2012 | Bastuji et al. | 312/228.1 |
| 2012/0298598 | A1 * | 11/2012 | Ennen et al. | 211/41.8 |
| 2013/0002107 | A1 * | 1/2013 | Paschini et al. | 312/228.1 |

FOREIGN PATENT DOCUMENTS

| | | |
|---|---|---|
| EP | 1859722 | 11/2007 |
| EP | 1925251 | 12/2008 |
| GB | 2321394 | 7/1998 |
| GB | 2356555 | 5/2001 |
| JP | 11-047065 | 2/1999 |
| WO | WO2008060029 | 5/2008 |

OTHER PUBLICATIONS

Written Opinion of the International Searching Authority for PCT/NZ2009/000256 completed on Jan. 14, 2010 (6 pages).

* cited by examiner

ADJUSTABLE SHELF ASSEMBLY AND APPLIANCES INCORPORATING THE ADJUSTABLE SHELF ASSEMBLY

This application is a United States National Phase filing of PCT/NZ2009/000256, having an International filing date of Nov. 24, 2009 which was published in English on Jun. 3, 2010 under International Publication Number WO 2010/062195 which claims the benefit of U.S. provisional patent application Ser. No. 61/118,569, filed on Nov. 28, 2008. These applications are hereby incorporated by reference in their entirety.

FIELD OF THE INVENTION

The present invention relates to an adjustable shelf assembly and appliances including the adjustable shelf assembly.

BACKGROUND

In appliances shelves are commonly provided. For example in dishwashers shelves are used to support crockery items for cleaning, in refrigerators shelves are used for storing items. Shelves are provided in various sizes and their size is dictated by their intended purpose. For example the a dishwasher shelf or rack to hold small items like cups is generally smaller than a rack used to hold large dinner plates.

The prior art includes examples of adjustable shelves in appliances. EP 0937436 describes a dishwasher shelf that can be tipped up to a vertical position around a horizontal axis. The shelf can also be moved along the vertical axis in this tipped up position. U.S. Pat. No. 3,934,728 describes a dishwasher shelf that can pivot between a horizontal and vertical position. The shelf can be moved along the vertical axis once it is in a vertical position. EP 1925251 describes a dishwasher shelf to hold crockery items can be adjusted from a horizontal position to a vertical position.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art

SUMMARY OF INVENTION

It is an object of the present invention to provide an adjustable shelf assembly for an appliance that will at least provide the public with a useful choice, and to provide appliances including such a shelf assembly.

In a first aspect the invention may broadly be said to comprise an adjustable shelf assembly that comprises:

a bar, a carrier slideably engaged to the bar, a flexible gripping projection extending from the carrier, the gripping projection capable of flexing between a gripping position and sliding position, the gripping projection exerting a greater gripping force upon the bar when in the gripping position than when in the sliding position, and a shelf pivotally connected to and supported by the carrier, the shelf pivotable between a stowed position and a deployed position, the stowed position being more parallel to the bar than the deployed position, wherein the shelf acts on the carrier as the shelf moves from the stowed position to the deployed position, causing the gripping projection to flex from the sliding position to the gripping position and maintains the projection in the gripping position while the shelf is in the deployed position.

Preferably the adjustable shelf assembly including at least two bars, running parallel to each other and disposed a distance apart.

Preferably each bar has a carrier slideably engaged to the bar.

Preferably the two carriers are joined by an elongate body spanning between the bars.

Preferably each carrier includes a flexible gripping projection.

Preferably the length of the elongate body connecting between each carrier is smaller than the distance between the two bars, causing the bars to flex and causing the carrier and gripping projection to grip onto the bar in the gripping position and the sliding position.

Preferably the flexible gripping projection is the sliding position when the shelf is in the stowed position and the flexible gripping projection is in the gripping position when the shelf is in a deployed position.

Preferably the shelf includes a shoulder which exerts a force upon the gripping projection to move the gripping projection as the shelf pivots from a stowed position to the deployed position.

Preferably the shoulder forces the gripping position to move from a sliding position to a gripping position as the shelf pivots between the stowed position and the deployed position Preferably the shoulder includes a ramp surface that engages with the gripping projection to force the gripping projection from a sliding position to a gripping position as the shelf pivots between the stowed position and the deployed position.

Preferably the shoulder has a plurality of ramp surfaces that engage with the gripping projection forcing the gripping projection between a sliding position and a gripping position as the shelf pivots between the stowed position and the deployed position Preferably each ramp surface being in contact with the gripping projection and exerting a force on the gripping position for only a portion of the movement as the shelf pivots between a stowed position and a deployed position.

Preferably the carrier is made of a flexible polymer material.

Preferably the carrier comprises a channel defined by the gripping projection and a rigid wall opposite to the gripping projection, wherein the channel receives the bar and allows the carrier to slide along the bar.

Preferably the carrier includes a plurality of flexible gripping projections, the gripping projections moving between a sliding position to a gripping position as the shelf moves between a stowed position to a deployed position.

In a second aspect the invention may broadly be said to comprise an adjustable shelf assembly, the adjustable shelf assembly comprising:

a support, a shelf pivotally mounted to the support to pivot between a stowed position and a deployed position, and a cam and a cam follower that are elastically urged together, the cam moving across the cam follower as the shelf moves between a stowed position and a deployed position, the cam exerting a force on the cam follower to bias the shelf to prefer either of the stowed position and the deployed position.

Preferably the support includes two cam followers disposed a distance apart

Preferably the cam follower is resilient and more relaxed at the bias position, the resiliency of the cam follower biasing the shelf to either the stowed position or the deployed position.

Preferably the two cam followers are joined by the support extending between the two cam followers.

Preferably the cam has at least two flat surfaces, one surface engaging with the cam follower to bias the shelf toward the stowed position, the other surface engaging with the cam follower to bias the shelf toward the deployed position.

Preferably the adjustable shelf assembly comprises a bar, the support slideably engaged to the bar.

Preferably the bar is vertical.

Preferably the support is slideably engaged to two bars, each end of the support engaged to one bar.

Preferably the cam follower is biased to move toward the cam, such that the cam follower exerts an opposing force to the force from the cam in order to hold the shelf at the stowed or deployed condition.

Preferably the support is resilient.

Preferably the cam moves across the support, the support acting as the cam follower and exerting a force on the cam to hold the shelf between the stowed and deployed conditions.

Preferably the cam follower is a resilient tab extending from the support.

In a further aspect an appliance including an adjustable shelf assembly as described above.

In a third aspect the invention may be broadly said to comprise an adjustable shelf assembly comprising:

a bar, a support slideably mounted to the bar, a shelf pivotally mounted to the shelf support, the shelf biased to prefer two positions relative to the support, the support clamping more strongly to the bar when the shelf is in position than the other position.

Preferably the support includes at least one carrier, the carrier engaged to the bar.

Preferably the shelf assembly includes two parallel bars, the bars are disposed some distance apart.

Preferably the support has two carriers, each carrier engaged to only one bar and the support Preferably the support is an elongate body extending between the two carriers.

Preferably the support includes at least one gripping projection extending from the carrier Preferably the shelf is connected to and supported by the carrier.

Preferably the shelf pivots between a stowed position and a deployed position.

Preferably the stowed position the shelf is substantially parallel to the bar while in the deployed position the shelf is substantially perpendicular to the bar.

Preferably the gripping projection is capable of flexing between a sliding position and a gripping position, the gripping projection exerting a force on the bar in either the sliding or gripping position.

Preferably the gripping projection exerts a larger gripping force on the bar when it is in the gripping position than when the gripping projection is in a sliding position.

Preferably the distance of the elongate body attaching between each carrier is smaller than the distance between the two bars, causing the bars to flex and causing the carrier and gripping position to grip onto the bar when in either the sliding position or the gripping position.

Preferably the gripping projection flexes between a gripping and sliding position as the shelf pivots between two positions.

Preferably the gripping position of the gripping projection is achieved when the shelf is in a deployed position and the sliding position of the gripping projection is achieved when the shelf is in the stowed position.

Preferably the shelf includes a shoulder that exerts a force upon the gripping projection to move the gripping projection between a sliding position and a gripping position as the shelf pivots from stowed position to a deployed position.

Preferably the gripping position of the gripping position exerts a larger force upon the bar than the sliding position.

Preferably the support includes at least one cam follower and the shelf includes at least one cam, the cam follower and cam being elastically urged together.

Preferably the cam moves across the cam follower as the shelf pivots between two positions relative to the support.

Preferably the cam follower is resilient.

Preferably the cam exerts a force on the cam follower as the cam moves across the cam follower due to the shelf moving between two positions, the cam follower exerting an opposite force to hold the cam and the shelf at one of the two positions or in between.

Preferably the cam has two flat surfaces upon it, one surface engaging with the cam follower when the shelf is in the stowed position, the other surface engaging with the cam follower when the shelf is in a deployed position.

Preferably the cam follower is a resilient tab extending from the support.

Preferably the cam follower is biased to move toward the cam , such that the cam follower exerts an opposing force to the force from the cam, thus holding the shelf in the stowed or deployed position due to the force exerted from the cam follower Preferably the support includes two cam followers and the shelf includes two cams, each cam interacting with only one cam follower.

Preferably the support is resilient

Preferably the support acts as the cam follower, the cam or cams acting on the support as the shelf moves from a stowed position to a deployed position, the cam or cams exerting a force upon the support to hold the shelf in either the stowed or deployed position.

Preferably the shelf assembly includes a gripping projection extending from the support, the gripping projection capable of flexing between a gripping position and a sliding position, the gripping projection exerting a more gripping force on the bar when it is in the gripping than when in the sliding position, a cam follower affixed to the support, a cam formed as part of the shelf; wherein the shelf acts on the support as the shelf moves from a stowed position to a deployed position, causing the gripping projection to flex from the sliding position to the gripping position and to maintain the gripping projection in the gripping position while the shelf is in the deployed position, the cam and cam follower are elastically urged together, and the cam moves across the cam follower as the shelf moves from a stowed position to a deployed position, the cam exerting a force on the cam follower to bias the shelf to either of the stowed or the deployed position.

In a further aspect a dishwasher including an adjustable shelf assembly as described above. Preferably said shelf comprises a network of horizontal elongate members and transverse elongate members, said transverse members being transverse to said horizontal members, said members arranged in a regular lattice.

Preferably said horizontal elongate members are curved toward the centre of the dishwasher tub. Preferably the shelf moving between a stowed position and deployed position causes said shoulder to exert a force upon said lattice of said shelf, in particular said force from said shoulder is exerted on said horizontal elongate members causing horizontal elongate members to flex from said curved shape to a horizontal substantially straight shape.

More preferably said horizontal elongate member is curved when said shelf is in the stowed position, said horizontal elongate member in the substantially straight shape when said shelf is in the deployed position, said horizontal member flexing from curved to straight as said shelf pivots between a stowed position to a deployed position Inventions herein may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The term "comprising" as used in the specification means "consisting at in part of". When interpreting each statement in this specification that includes the term "comprising", features other than that or those prefaced by the term may also be present. Related terms such as "comprise" and "comprises" are to be interpreted in the same manner

DETAILED DESCRIPTION

The adjustable shelf assembly is described below with reference to use as part of dishwasher basket for use in a dishwashing appliance. The adjustable shelf assembly is not limited for use as part of a dishwasher. The shelf assembly may be used in any other appliance for example in a refrigerator.

Figure 1:
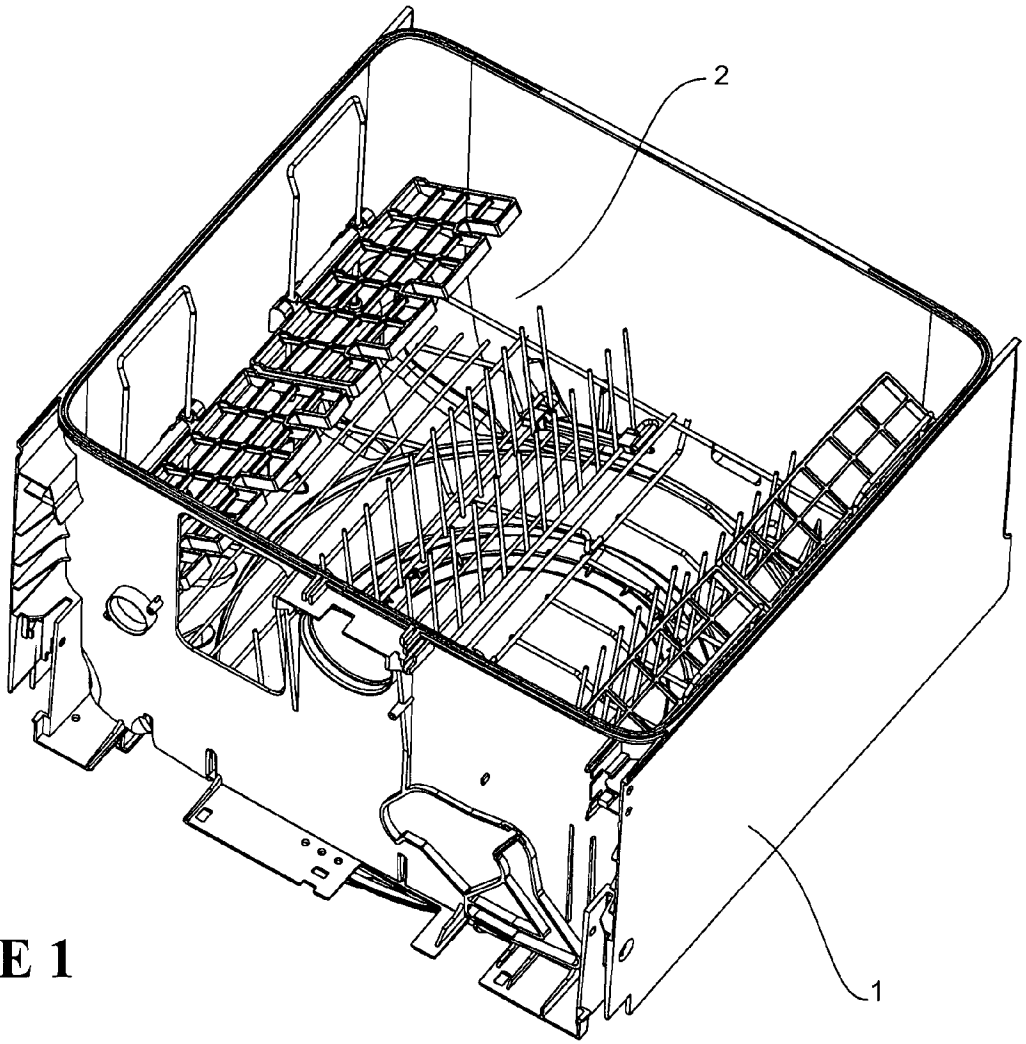
FIG. 1 shows an assembly view of a dishwasher wash chamber including a shelf assembly that embodies the present inventions.
Figure 2:
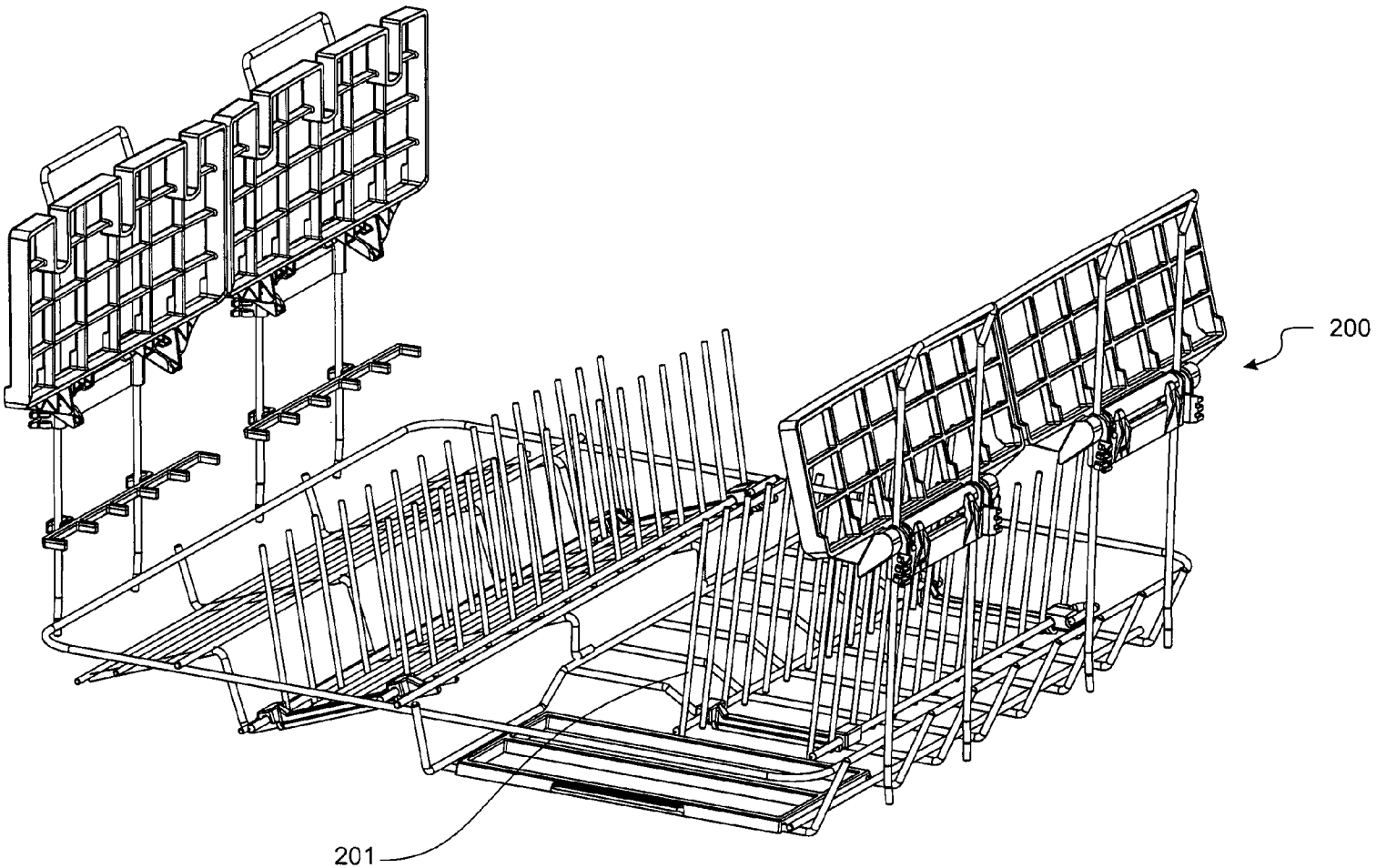
FIG. 2 is an assembly view of crockery supports included in the wash chamber of FIG. 1. The drawing shows a basket or rack with tines and several shelf assemblies.

A dishwasher wash chamber incorporating the adjustable shelf assembly is illustrated in FIG. 1 and FIG. 2. The dishwasher includes a case (not shown), a wash tub 1 within the casing and a crockery basket 2 within the wash tub 1. The basket also includes the adjustable shelf assembly 200 to hold and receive smaller crockery items, stem ware and other smaller utensils.

Figure 3:
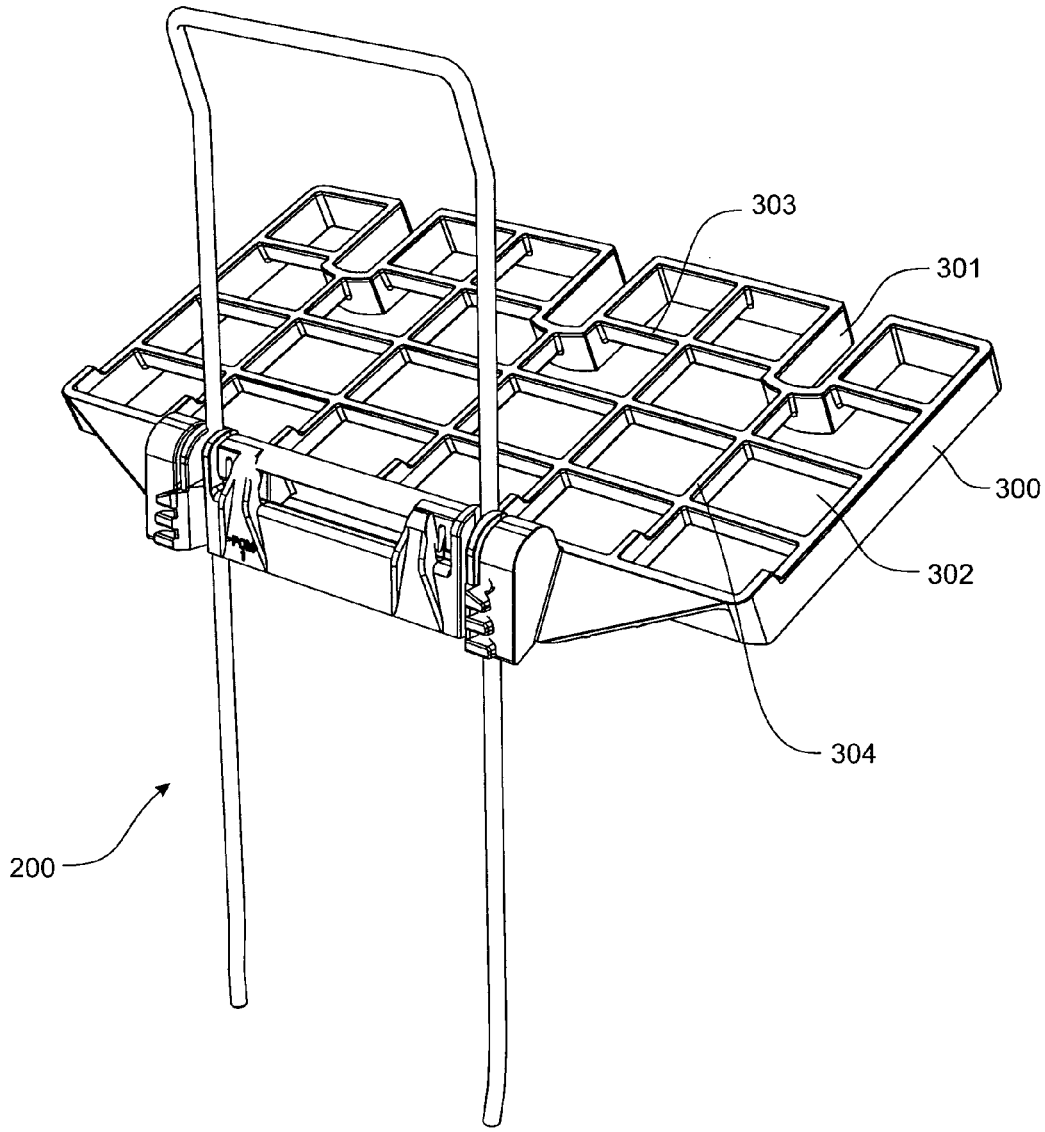
FIG. 3 is perspective view of a shelf assembly from FIG. 2. The shelf assembly includes a shelf.

The following is a description of the preferred shelf. The shelf as described is used in conjunction with all the preferred embodiments of the shelf assembly. The preferred form of the shelf 300 is shown in FIG. 3, along with a general adjustable shelf assembly 200. The shelf 300 is generally rectangular. The shelf 300 is rectangular in order to hold any crockery items like cups, small dishes, and large spoons and so on. Alternatively the shelf 300 could be any other suitable shape.

The shelf has a plurality of slots 301 or grooves along the edge distal to the shelf support. These slots are used to hold stemware during the washing process. These slots may be resilient and can flex open slightly if there is a force applied upon the two open ends. The resilience in the slot allows the slot to grip on to the stemware.

The preferred shelf is comprised of a lattice 302. The holes in the lattice 302 allow wash water to flow around the crockery items through the shelf in order to clean the crockery items. As an alternative the shelf may be solid with no holes. Preferably the lattice 302 has a rounded side extending from the shelf. In the preferred form the lattice 302 is formed integral to the shelf 300. Alternatively the lattice 302 may be formed as a separate piece to the shelf 300 and attached to the shelf 300 via a clipping mechanism, inserting mechanism or fastening mechanism.

The shelf 300 is preferably moveable between a stowed position and a deployed position. In the most preferred the shelf receives and retains crockery or other items when it is in the deployed position.

The shelf may be made of any suitable material. In its preferred form the shelf is made of a plastic polymer by moulding or vacuum forming. The use of the shelf as part of the shelf assembly will be described in more detail below.

The following description describes the three aspects of the shelf assembly

The first aspect of the shelf assembly will be described with respect to FIGS. 3 to 7. The shelf assembly 200 includes a bar 400 and a carrier 401 slideably engaged to the bar. A flexible gripping projection 402 extends from the carrier. The gripping projection is capable of flexing between a gripping position and a sliding position. The shelf 300 is pivotally connected and supported by the carrier. The shelf is pivotable between a stowed position and a deployed position.

Figure 4:
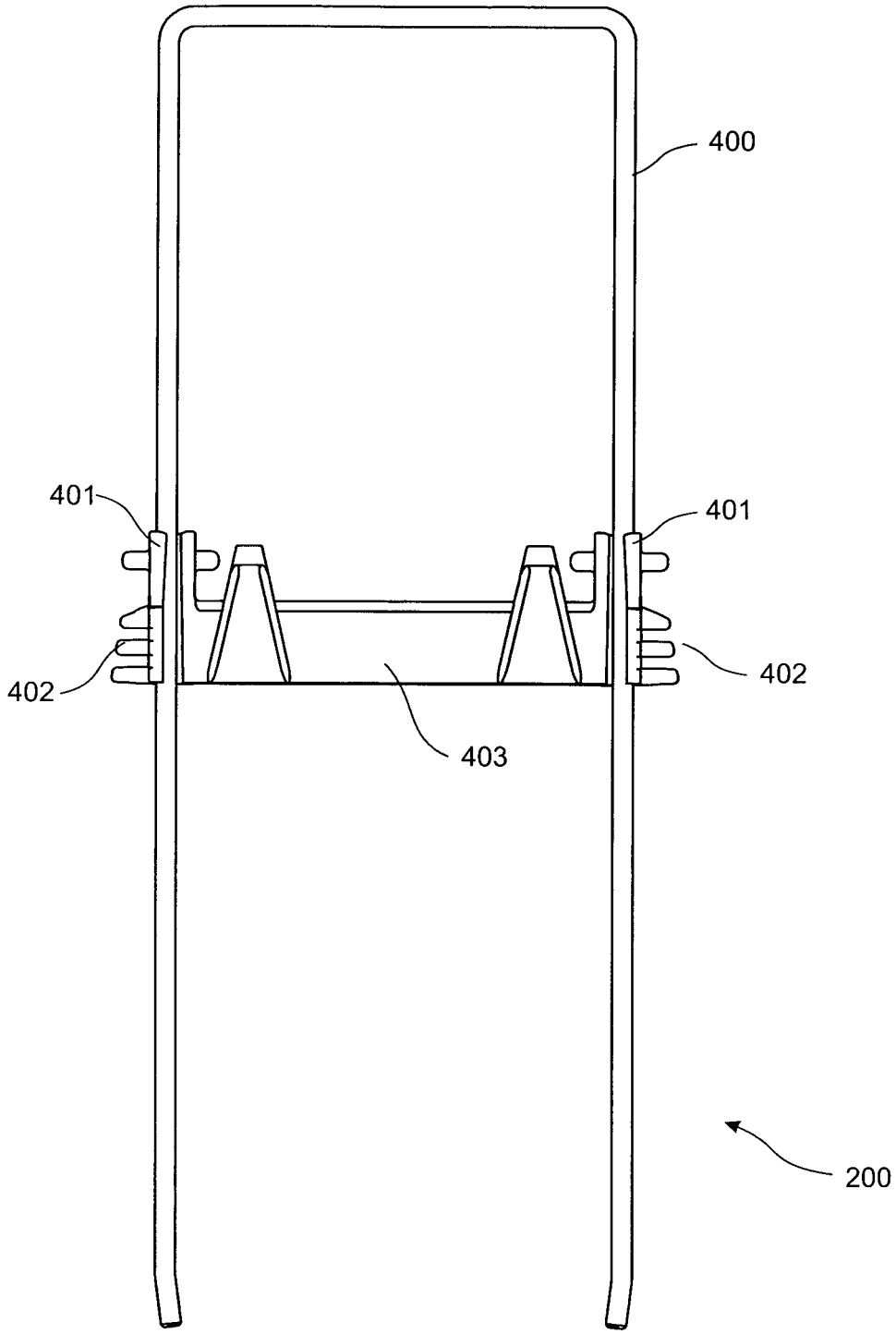
FIG. 4 is a side view of the shelf assembly of FIG. 2 with the shelf removed. The figure shows a support engaged between two bars.
Figure 5:
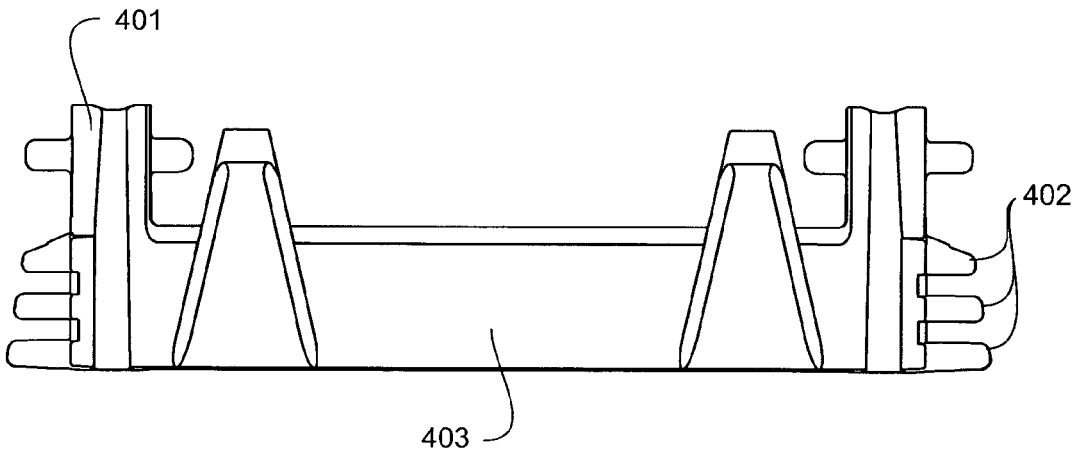
FIG. 5 shows a detailed view of the support of FIG. 4.
Figure 6A:
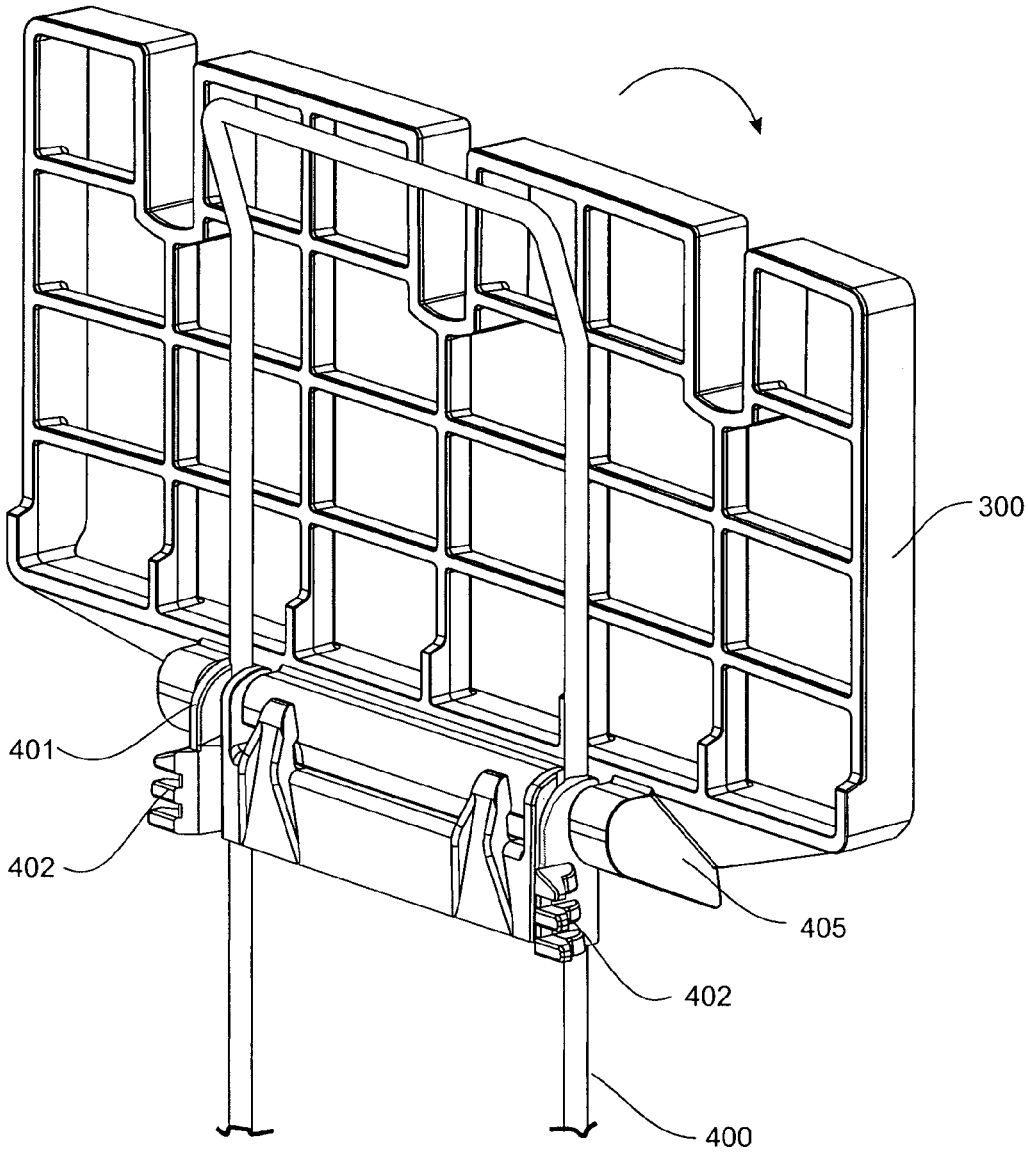
FIGS. 6*a* and 6*b* are two views of the shelf assembly of FIG. 3 illustrating pivoting movement of the shelf.
Figure 6B:
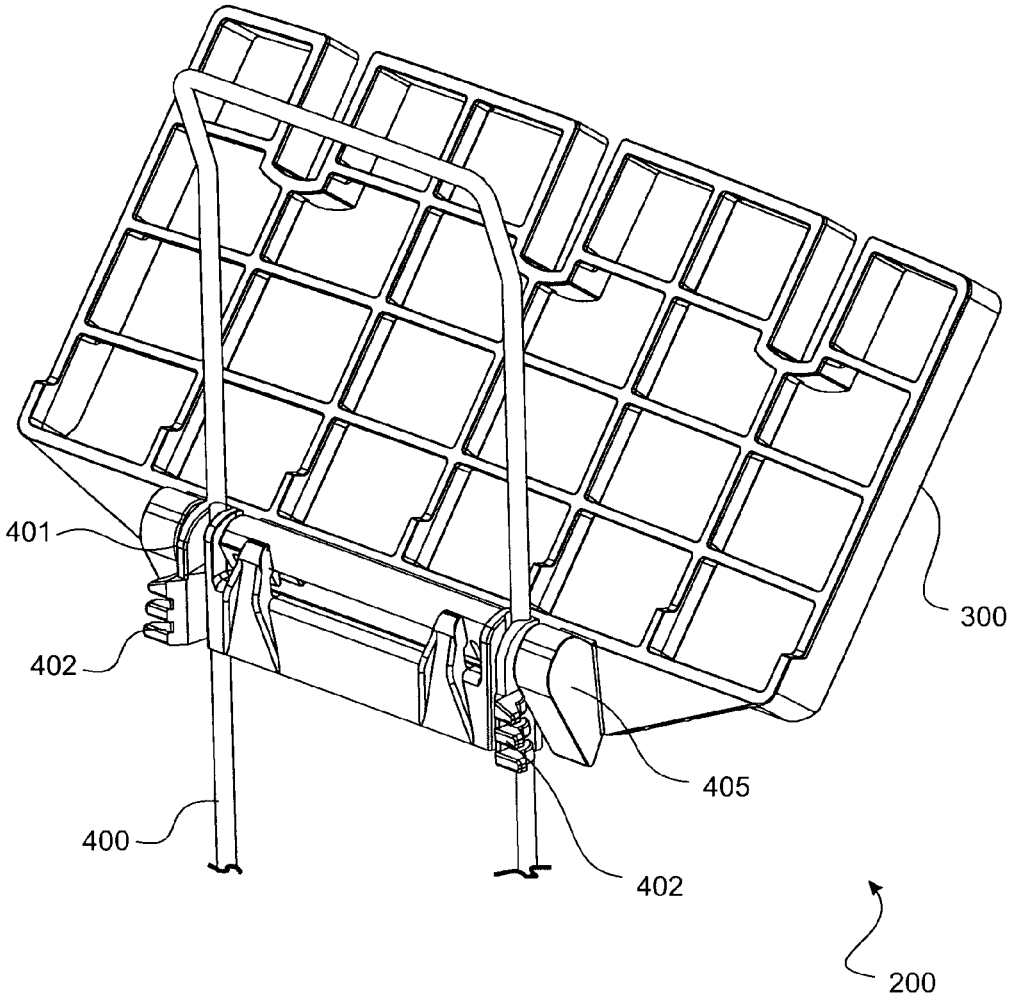

The bar may be vertical wire of the dishwasher basket or separate from the dishwasher basket as shown on FIG. 4. The bar 400 is preferably long and slender and strong enough to support the weight of the entire shelf assembly. The bar and the dishwasher basket are preferably made of a plastic polymer or of plastic coated steel wire or any other suitable material. Preferably the bars 400 of shelf assembly 200 are flexible and can bend to a certain extent if a force is acting on them. The bar 400 may be supported at its upper end and at its lower end.

Figure 7:
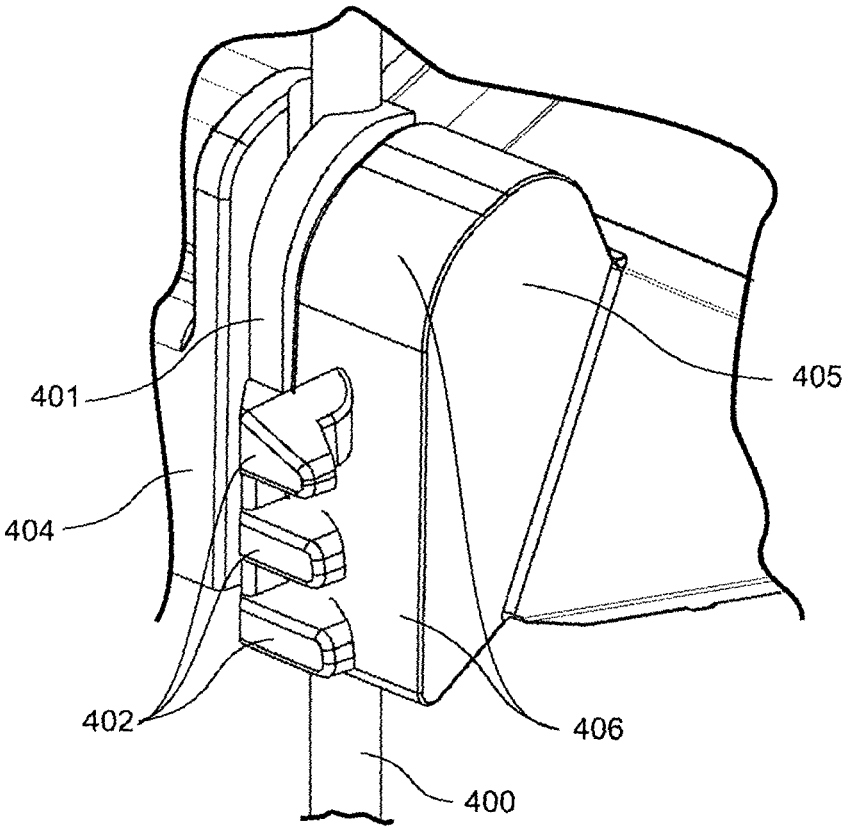
FIG. 7 is a magnified view of a portion of FIG. 3.

The carrier 401 supports the weight of the shelf 300. The carrier 401 has a jaw like shape that clips on the bar, as seen in FIG. 7. The carrier 401 is adapted to slide up and down along the bar. Since the shelf 300 is attached to the carrier, the movement of the carrier 401 along the bar 400 also moves the shelf vertically along the bar 400.

In the preferred form the shelf assembly 200 includes two carriers 401 attached respectively to two bars 400 running parallel to each other. The carriers 401 are connected by an elongate body 403 spanning the distance between the two bars 400.

Preferably the distance between the two bars is slightly greater than the distance between the jaws of the respective carriers. For example the distance between the bars maybe 90 mm and the distance between the two carriers 401 may be 87.5 mm. Due to this difference the carriers exert a gripping force onto the bars 400. The shorter span causes the flexible bars 400 to bend and exert an opposite force upon the carriers to support the carriers.

The carrier is preferably constructed of a rigid plastic polymer material or any other suitable material.

A flexible gripping projection 402 extends from each carrier. A single flexible gripping projection 402 may extend from each carrier 401. Alternatively the carrier 401 may include a plurality of flexible gripping projections 402 as shown in FIG. 7. Preferably the carrier 401 includes 3 gripping projections, but could alternatively include any number. The flexible gripping projecting 402 may be formed integral with the carrier 401, for example by injection moulding.

The flexible gripping projection 402 is capable of flexing between a sliding position and a gripping position. The flexible gripping projection 402 bends toward the bar and essentially grips the bar 400 as it moves from a sliding position to a gripping position. The flexible gripping projection 402 exerts a larger gripping force on the bar 400 when in the gripping position than when in the sliding position. Preferably the clamping or gripping force on the bar is enough to hold up a fully loaded shelf and shelf assembly.

The flexible gripping projection 402 and the rigid wall 404 opposite the flexible gripping projection form a channel like shape that receives the bar and allows the carrier 401 and gripping projection 402 and hence the shelf 300 to slide up and down along the bar. Preferably the rigid wall opposite the gripping projection is part of the carrier, as seen in FIG. 7.

In the preferred form the flexible gripping projection(s) 402 is part of the carrier 401. The flexible gripping projection 402 could be formed of the same plastic material as the rest of the carrier, or of a different material. For example the gripping projection could be over moulded from a softer material.

The shelf 300 includes a shoulder 405 that acts upon the flexible gripping projection to make the gripping projection flex between a sliding and a gripping projection. The shoulder and its interaction with the gripping projection is explained in detail below.

Preferably the shoulder 405 has a rounded side extending from the shelf. In the preferred form the shoulder 405 is formed integral to the shelf 300. However alternatively the shoulder 405 may also be formed as a separate piece and attached to the shelf 300.

The shoulder 400 acts on the gripping projection 402 as the shelf 200 pivots to force the gripping projection 402 to flex between a sliding position and gripping position. In the illustrated embodiment of the shelf assembly the shelf 300 pivots between a stowed position and a deployed position. In the stowed position the shelf 300 is substantially parallel to the bar, while in the deployed position the shelf is substantially perpendicular to the bar. In the stowed position the shelf is more parallel to the bar than in the deployed position.

The pivot axis of the shelf 300 may run through the shoulder 405. Alternatively the pivot axis of the shelf 300 may not pass through the shoulder.

In the most preferred form the gripping projection is in the sliding position when the shelf is in the stowed position, and the gripping projection 402 is in the gripping position when the shelf 300 is in the deployed position. In the sliding position the flexible gripping projection 402 is in a neutral or 'at rest' position. In the sliding position the flexible gripping projection 402 is not flexed and has no force acting on it. The flexible gripping projection 402 flexes from a sliding position to a gripping position as a force acts upon the flexible gripping projection 402.

In the first preferred embodiment as the shelf 300 pivots from a stowed position to a deployed position, the shoulder 405 rotates through a radius. The shoulder 405 acts against the flexible gripping projection 402 and exerts a force on it to move the gripping projection 402 from the sliding position to the gripping position.

Preferably the shoulder 405 has at least one ramp surface 406 on it that engages with the flexible gripping projection 402 as the shoulder 405 and shelf 300 pivots. The ramp surface 406 pushes against the gripping projection 402 forcing the gripping projection 402 to flex from the sliding position to the gripping position. Even more preferably the shoulder 405 includes a plurality of ramp surfaces 406 that cause the gripping projection 402 to flex from the sliding position to a gripping position. Once the shelf is in the deployed position, the shoulder 405 keeps a force upon the gripping projection 402 to maintain the gripping projection 402 in the gripping position. As the shelf 300 pivots from the deployed position to the stowed position the shoulder exerts less force on the gripping projection 402 allowing the gripping projection 402 to flex back toward the sliding position. When the shelf 300 is in the stowed position the shoulder does not act against the gripping projection and hence the ramp surfaces 406 and shoulder 405 do not exert a force upon the gripping projection 402. While the shelf 300 is in the stowed position and while the gripping projection 402 is in the sliding position.

This aspect of the shelf assembly allows the shelf 300 and carrier 401 to slide up and down along the bar 400. The shelf 300 and carrier 401 can be secured at any position along the bar 400.

In the preferred form the lattice 302 comprises a plurality of elongate members arranged in a regular pattern with gaps between the elongate members. The lattice comprises horizontal members 303 and transverse 304. The transverse members 304 are transverse to the horizontal members 303. The directions horizontal and transverse are defined when looking at the shelf in the operative position from the top, as shown in FIG. 13. The horizontal and transverse members 303, 304 are perpendicular to each other and are integral to each other. Alternatively the members 303 and 304 may be separate to each other and may be connected to each other by a fastening or clipping mechanism (not shown) or may be adhesively connected to each other. Preferably the horizontal members are curved away from the gripping projection 402, and are curved such that they extend toward the middle of the wash tub.

The horizontal members 303 remain in their curved position when the gripping position is in its sliding position and the shelf is in the stowed position. The horizontal members change shape from curved to substantially straight and substantially parallel to wall of the tub in the horizontal direction as a result of the shoulder 405 experiencing a counter gripping force in the opposite direction to the gripping force from the gripping projection 402 as the gripping projection 402 is moved to a gripping position. This counter gripping force exerts a force upon the horizontal members 303 of the lattice 302, forcing the horizontal members 303 to change their shape from curved to a substantially straight and horizontal shape. When the gripping projection 402 is moved back to sliding position and the shelf 300 is moved to the stowed position the horizontal members 303 return to their curved or convex shape. The advantage of this is that the shelf is more aesthetically pleasing to a user and fits better into the tub.

Figure 9:
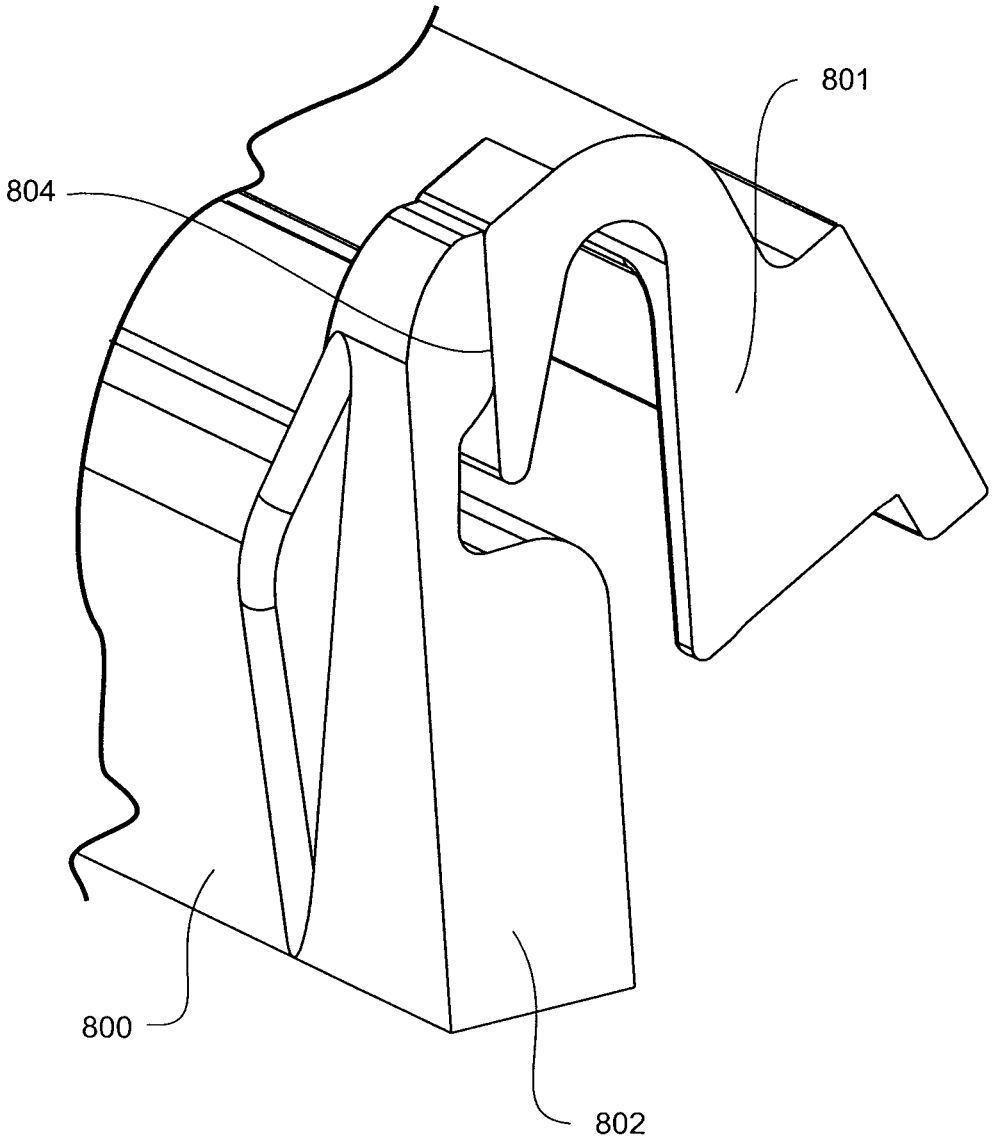
FIG. 9 and FIG. 10 are magnified views of a cam and cam follower detail of FIG. 8. The figures show the interaction between the cam and cam follower as with the shelf in two different positions.
Figure 10:
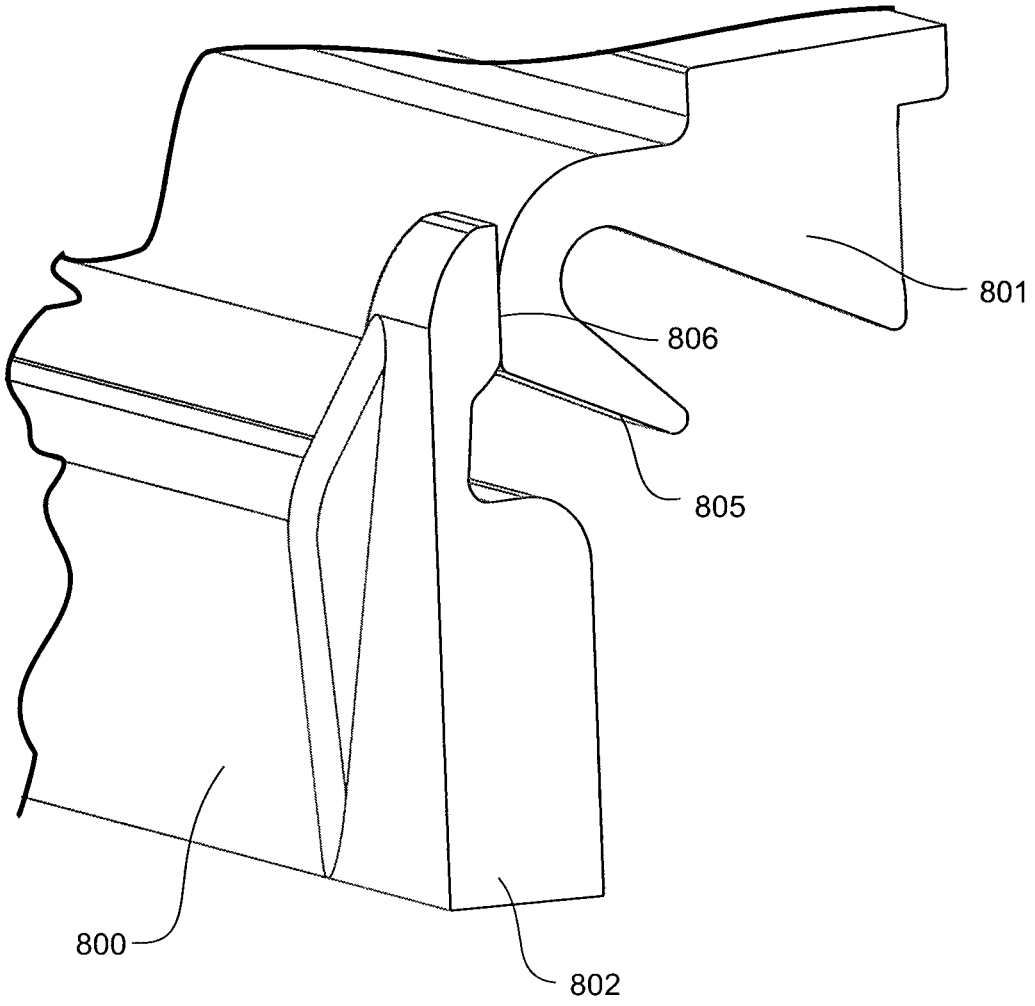
Figure 11:
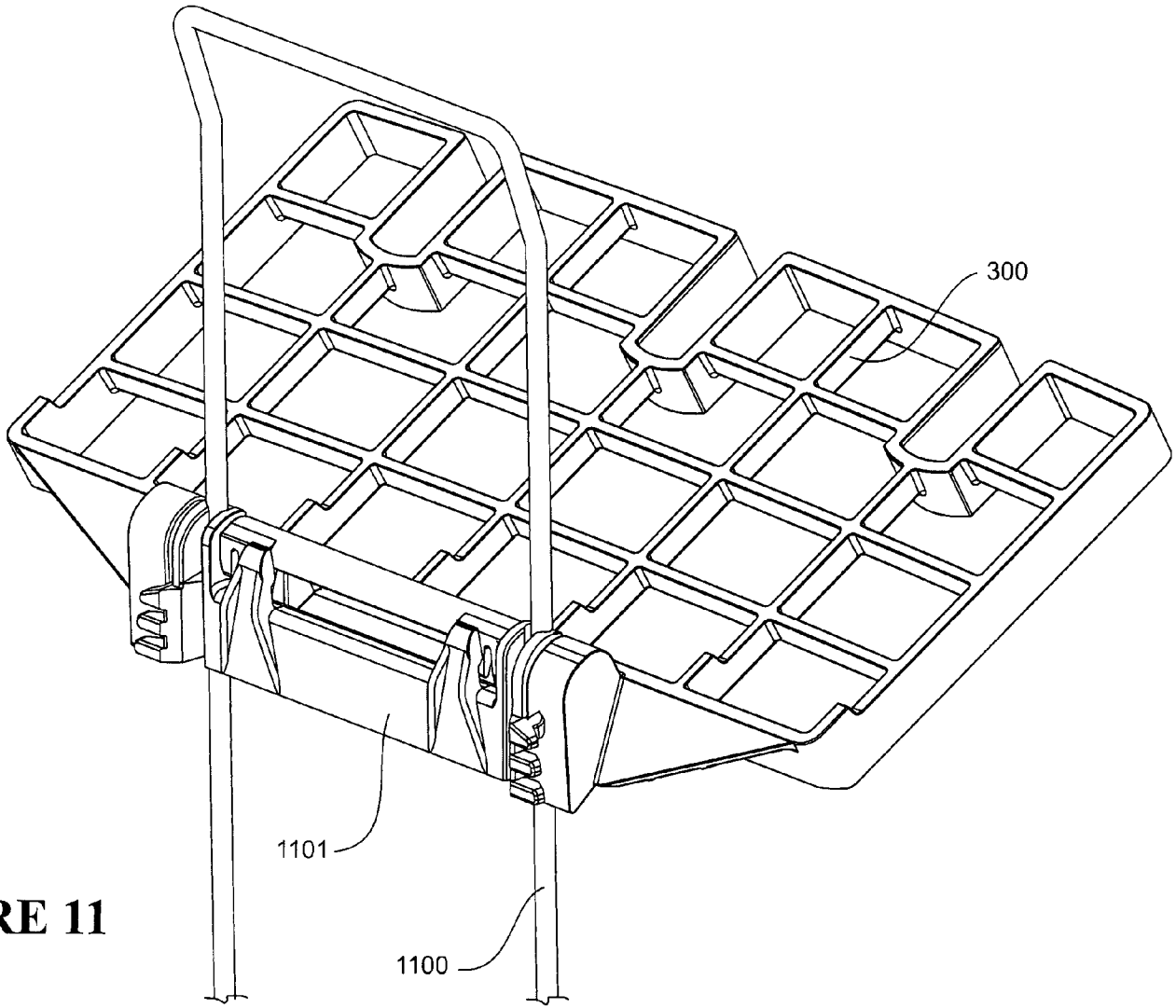
FIG. 11 and FIG. 12 are perspective views of the shelf assembly. The views show the shelf in to different positions
Figure 12:
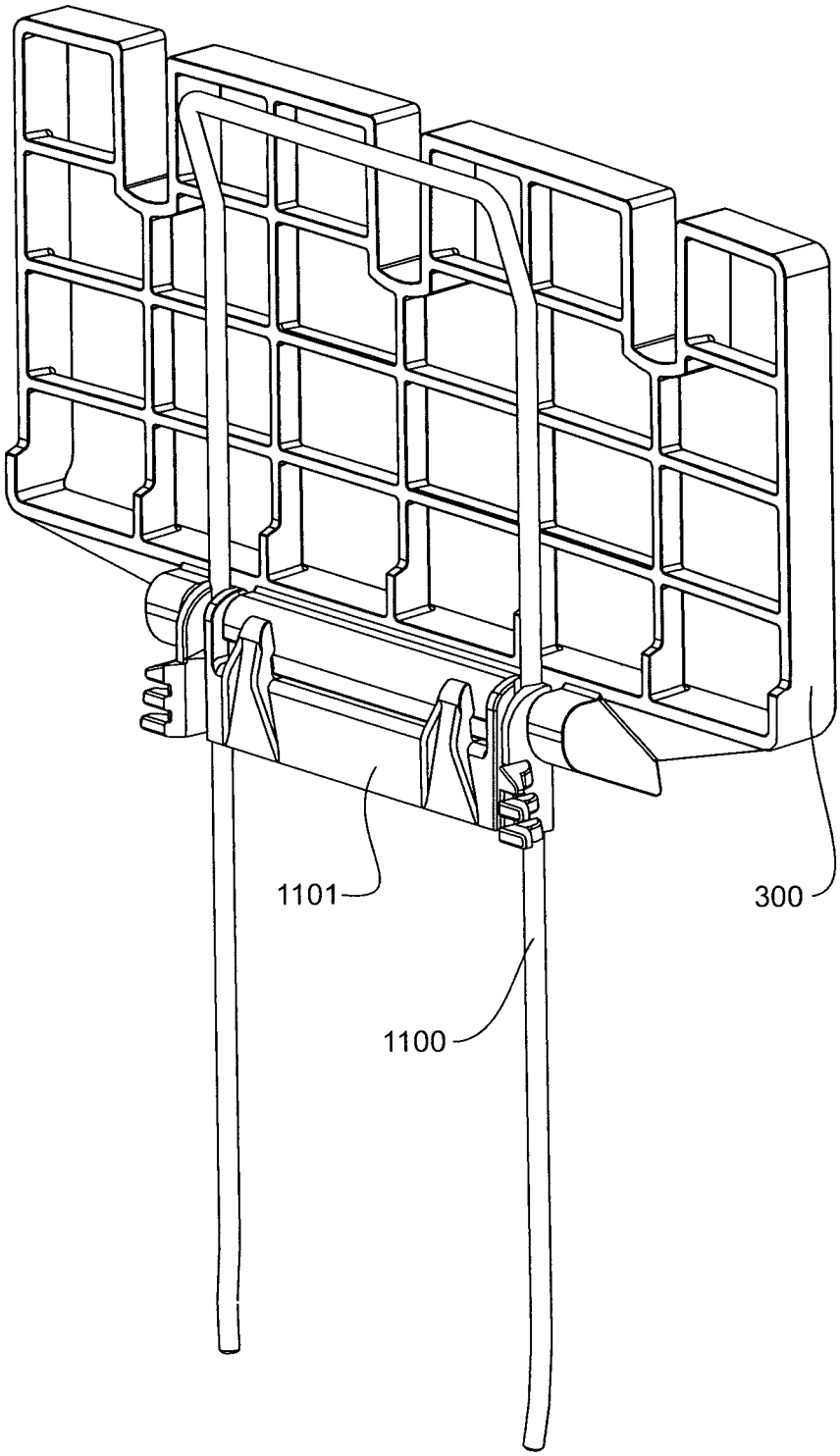

A second aspect of the shelf assembly will now be described with reference to FIGS. 8 to 10. The shelf assembly broadly includes a support 800, and a shelf 300 as described earlier pivotally mounted to the support to pivot between a stowed position and a deployed position. A cam 801 and cam follower 802 are elastically urged together. The cam and cam follower control the stop positions of the shelf.

Figure 8:
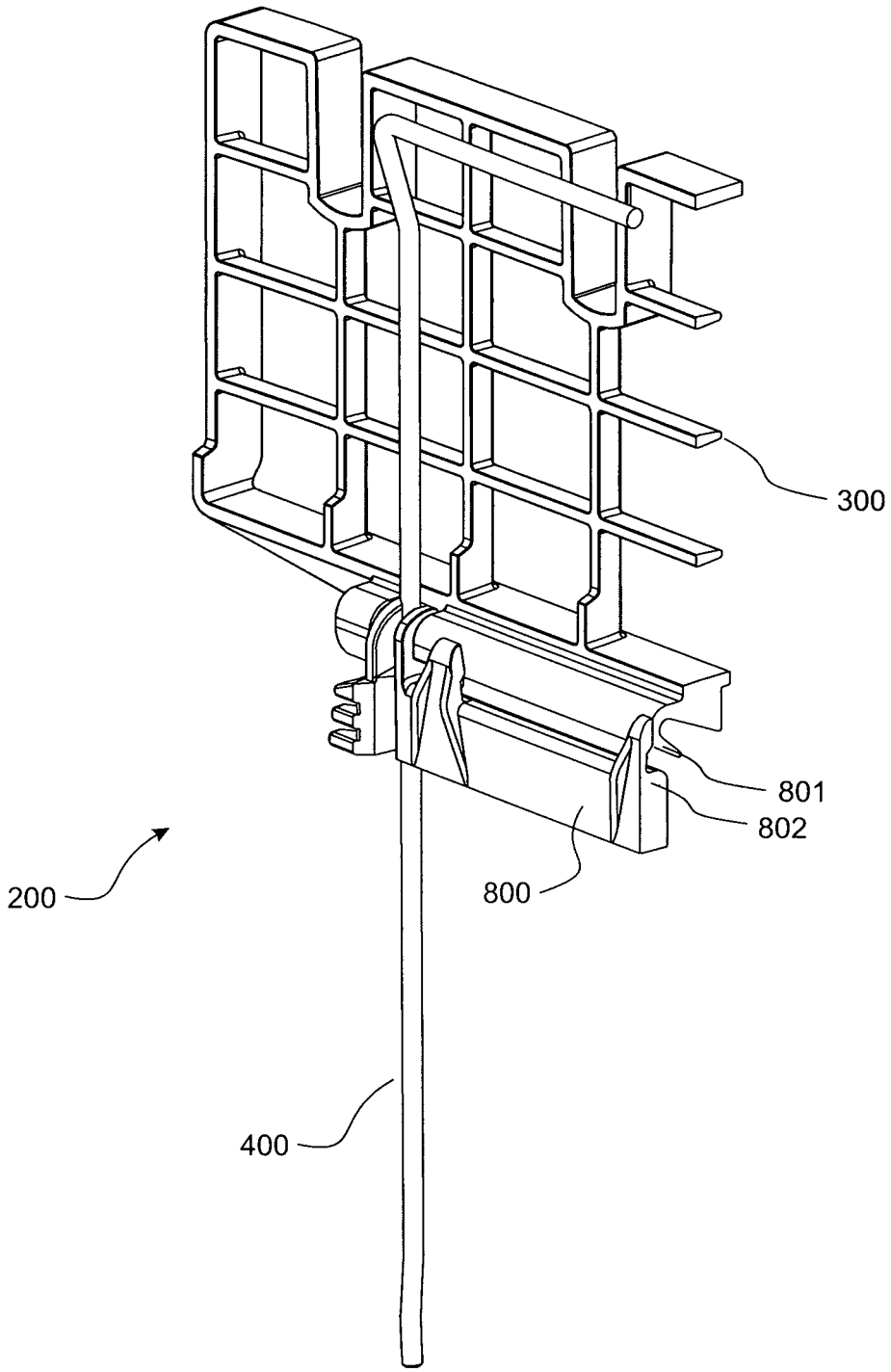
FIG. 8 is a cutaway perspective view of the second adjustable shelf assembly.

Referring to FIG. 8 the support may be an elongate body spanning between two bars 400.

The support 800 may be attached to the bar 400 in way that allows the support 800 and so the entire shelf assembly 200 to slide up and down along the bar. For example the support 800 may be clipped to the bar by a clipping mechanism such as a circlip or any other suitable clip. Preferably the support has two slots at its two most extreme tips. The two slots receive the bar. The slots are preferably partially resilient and hence can flex open as the bar is pushed into the slot and flex to grip the bar, once the bar has been pushed into the slot. As an alternative the support 800 could be fastened to the bars by a fastening means such as a bolt, screw, or any other suitable fastening means.

A shelf 300 is pivotally mounted to the support 800. The shelf 300 can pivot between a stowed and a deployed position. The shelf 300 may be parallel to the bar 400 while in the stowed position, and substantially perpendicular to the bar in the deployed position. The shelf is able to receive and hold crockery items in the deployed position. The shelf 300 may be mounted to the support 800 by an axle that allows the shelf to pivot. For example an integral axle portion extending from one part and engaged in a socket of the other.

The cam and cam follower will be described with reference to FIGS. 8 to 10. The cam and the cam follower interact together to hold the shelf in either the stowed or deployed positions. The descriptions are only of preferred forms and are illustrative of the working of the cam and cam follower. The shelf assembly 200 includes a cam follower 802. Preferably this cam follower 802 extends from the support 400. Preferably the support 800 includes two cam followers 802 extending from the support 800. Preferably the cam followers are at the two most extreme ends of the support, proximal to the bars, as seen in FIG. 8. In the most preferred form the cam followers 802 are two tabs extending from the support 800.

The tabs 802 may be integrally formed with the support 800. However as an alternative the tabs 802 may be formed separately and then attached to the support 800. In the preferred form the cam follower 802 or tab has a flat surface 804 on it as shown in FIG. 9. Even more preferably the cam follower 802 is a small projection with a curved face on its back face, the face most distal to the shelf 300. The top of the tab 802 has small flat surfaces that act as cam surfaces, these will be explained later. In the most preferred form the cam follower 802 is resilient and can flex forward and backward, where forward means towards the shelf 300 and backward means away from the shelf 300.

The shelf assembly 200 includes at least one cam 801. Preferably the cam 801 extends from the shelf 300.

Preferably the cam 801 is a long body extending from the shelf 300. The cam 801 is long enough to span across the distance between the two cam followers 802. Preferably the cam has at least two flat surfaces 805, 806 on it and a curved face between the flats. The cam may form a cantilever from the shelf 300 to form a hook as seen in FIG. 10.

The cam 801 and cam follower 802 or followers are elastically urged together. This means the surface of cam 801 moves across the surface of cam follower 802 as the shelf 300 pivots between the stowed and deployed position. The cam 801 exerts a force upon the cam follower 802 to bias the shelf 300 to prefer either of the stowed or deployed positions.

The cam 801 has at least two flat surfaces. As the shelf 300 moves between a stowed and deployed position the cam 801 moves across the cam follower 802, one flat surface on the cam engages with flat surface on the cam follower 802 to bias the shelf 300 to prefer the stowed position. The other flat surface on the cam 801 engages with the surface on the cam follower 802 to bias the shelf to prefer the deployed position.

The shelf is biased toward either the stowed or deployed position because of the force required to flex the cam follower 802 in moving from a relatively lower flat surface across the transition to the relatively higher surface between flats.

The cam 801 may include a plurality of flat surfaces. This would allow the shelf 300 to be stopped and kept at other positions in between the stowed and deployed position.

In an alternative form the support 800 acts as the cam follower 802, and so the support does not include any other specific cam followers like the tab described above. In this alternative form the support 800 is resilient. The support 800 may extend upward some distance so that the cam 801 can move across the support 800. The cam moves 801 across the support 800 as the shelf 300 pivots between a stowed and deployed position. As the cam moves across the support it bends the support back or bends an arm portion of the cam. The support acting as a cam follower shares the same function as a tab acting as cam follower.

A third aspect of the shelf assembly will be described with reference to 11 to 12. Features of the third embodiment are similar to features in the first and second and are described using like terms and like reference numbers.

The adjustable shelf assembly includes a bar 1100, a support 1101 slideably mounted to the bar and a shelf 300 pivotally mounted to the support 1101. The shelf 300 is biased to two positions relative to the support and the support clamping more strongly onto the bar when the shelf is in one position than the other position.

The support clamps to the bar urging the gripping arrangement explained earlier with reference to FIGS. 3 to 7. The support has a bias position at, at least the stowed position or the deployed position using a cam and cam follower arrangement as described above with reference to FIGS. 8 to 10. The combination provides a shelf that can pivot between secure deployed and stowed positions, can be deployed at any vertical location, provides secure grip on the bar when deployed.

While the invention is susceptible to embodiment in different forms, specific embodiments are described in this specification with respect to the drawings. The present disclosure is to be considered an exemplification of the principles of the invention, and is not intended to limit the invention or the scope of the invention to that as illustrated or described herein.

I claim:

1. An adjustable shelf assembly used in a kitchen appliance, the shelf assembly comprising:

a bar configured to be mounted within the kitchen appliance, a carrier slideably engaged to the bar, a flexible gripping projection extending from the carrier, wherein the carrier comprises a channel defined by the gripping projection and a rigid wall opposite to the gripping projection, wherein the channel receives the bar and allows the carrier to slide along the bar, the gripping projection in use flexes between a gripping position and a sliding position, wherein the gripping projection bends toward the bar and grips the bar as it moves from the sliding position to the gripping position exerting a greater gripping force upon the bar when in the gripping position than when in the sliding position, and a shelf pivotally connected to and supported by the carrier, the shelf pivotable between a stowed position and a deployed position, the stowed position being more parallel to the bar than the deployed position, wherein the shelf acts on the carrier as the shelf moves from the stowed position to the deployed position, causing the gripping projection to flex from the sliding position to the gripping position maintaining the gripping projection in the gripping position while the shelf is in the deployed position such that the gripping force in the gripping position holds the shelf in place on the bar in the deployed position.

2. An adjustable shelf assembly as claimed in claim 1, comprising at least two parallel spaced apart bars, wherein each bar has a carrier slideably engaged thereto, and wherein each carrier includes a flexible gripping projection.

3. An adjustable shelf assembly as claimed in claim 1, comprising two parallel spaced apart bars, wherein each bar has a carrier slideably engaged thereto, wherein the two carriers are joined by an elongate body spanning between the two bars; wherein the length of the elongate body joining the carriers is smaller than a distance between the two bars, causing the bars to flex and causing each carrier and each gripping projection to grip onto a corresponding bar in the gripping position and the sliding position.

4. An adjustable shelf assembly as claimed in claim 1, wherein the shelf includes a shoulder which exerts a force upon the gripping projection to move the gripping projection as the shelf pivots from the stowed position to the deployed position, and the shoulder forces the gripping projection to move from the sliding position to the gripping position as the shelf pivots between the stowed position and the deployed position.

5. An adjustable shelf assembly as claimed in claim 4, wherein the shoulder includes a ramp surface that engages the gripping projection to force the gripping projection from the sliding position to the gripping position as the shelf pivots between the stowed position and the deployed position.

6. An adjustable shelf assembly as claimed in claim 5, wherein the shoulder has a plurality of ramp surfaces that engage the gripping projection forcing the gripping projection between the sliding position and the gripping position as the shelf pivots between the stowed position and the deployed position, each ramp surface being in contact with and exerting a force on the gripping projection for only a portion of the movement as the shelf pivots between the stowed position and the deployed position.

* * * * *